United States Patent [19]

Alexander, III et al.

[11] 4,216,804

[45] Aug. 12, 1980

[54] LOOM CLOTH TENSION CONTROL

[75] Inventors: William J. Alexander, III, Mauldin; John S. Cooper, Fountain Inn, both of S.C.

[73] Assignee: Alexander-Cooper, Inc., Mauldin, S.C.

[21] Appl. No.: 947,413

[22] Filed: Oct. 2, 1978

[51] Int. Cl.[2] ..... D03D 49/20

[52] U.S. Cl. ..... 139/311; 242/45; 242/75.51

[58] Field of Search ..... 139/304, 309, 311; 66/149 R, 152; 242/45 X, 75.5, 75.51 X

[56] References Cited

U.S. PATENT DOCUMENTS

| | | | |
|---|---|---|---|
| 406,327 | 7/1889 | Wright | 139/311 |
| 2,760,734 | 8/1956 | Hornberger | 242/75.51 |
| 2,825,016 | 2/1958 | Bailey | 242/75.51 |
| 2,844,773 | 7/1958 | Turner et al. | 242/45 |
| 3,164,332 | 1/1965 | Walker et al. | 139/309 |
| 3,365,143 | 1/1968 | Espel | 242/75.51 |
| 3,525,367 | 8/1970 | Sprague | 139/304 |

*Primary Examiner*—Henry Jaudon

*Attorney, Agent, or Firm*—Bailey, Dority & Flint

[57] ABSTRACT

A tension control mechanism for cloth delivered from the loom and the like to a cloth roll carried by take-up mechanism positioned in front of the loom is illustrated wherein a sensing device engages the cloth coming from the loom under relatively light tension for driving motor control means responsive to movement of the sensor imparted thereto by variation in cloth tension.

2 Claims, 2 Drawing Figures

LOOM CLOTH TENSION CONTROL

BACKGROUND OF THE INVENTION

Various control mechanisms have been provided heretofore for controlling the tension in cloth wound upon large rolls upon take-ups of the type positioned in front of the loom employing spaced aligned rolls. U.S. Letters Pat. Nos. 3,433,430 and 3,525,367 illustrate apparatus utilizing changes in cloth loading to continuously sense and control the speed of the motor drive units to maintain a preset fabric tension level. Contrary to this, it is the purpose of the present invention to control motor operation as through a transformer or rheostat mechanism which is driven by a sensing means engagable with the cloth. It is possible to thus maintain a light tension in the cloth coming from the loom as opposed to the previously relatively heavy tension necessitated for control of prior art mechanisms. Prior devices such as those illustrated in the patents referred to above, produce variations in tension resulting from variations in plant voltage and inability to compensate for variations in tension which result from the size differential in the roll from start to finish.

Accordingly, it is an important object of the present invention to utilize a gravity controlled sensing device for driving a motor control mechanism making possible reliable tension control within very small differentials in tension and which will provide, through the addition of limit switches, a range of permissible tension variations within which the control hereof is to operate.

BRIEF DESCRIPTION OF THE INVENTION

It has been found that a tension control apparatus may be provided for use in connection with loom cloth by a feed forwardly of the loom to a cloth roll utilizing a sensing device operated by gravity to vary the torque on the motor by driving a motor control device through movement of the sensor resulting in varitions in the cloth tension. The apparatus hereof is especially useful in connection with cloth inspection devices wherein it is first led in an upward path and thence downwardly and laterally or horizontally to be wound upon the cloth roll. Since a light tension is required, it is important that the apparatus of the present invention sense minor variations in tension and effectively and positively control the motor drive mechanism in order to reflect such variations in tension to permit motor control in such a manner as to compensate therefor.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

A loom tension control apparatus is illustrated for use in a take-up having a motor driving a pair of spaced take-up rolls supporting a cloth roll therebetween. The take-up is positioned in front of a loom from which cloth is delivered in open width to the cloth roll for winding thereon into a large roll. Means including a guide roll A are provided for conveying the cloth in a substantially horizontal run during its passage to the cloth roll. A control shaft B is carried for oscillation in alignment with the spaced take-up rolls. A movable roll C is supported by the cloth in the horizontal run. Means including support arms D are provided for mounting the movable roll on the control shaft for oscillating same responsive to variations in tension in the lateral run. Motor control means E are provided with suitable drive means F connecting it for operation responsive to the oscillations of the control shaft.

Figure 1:
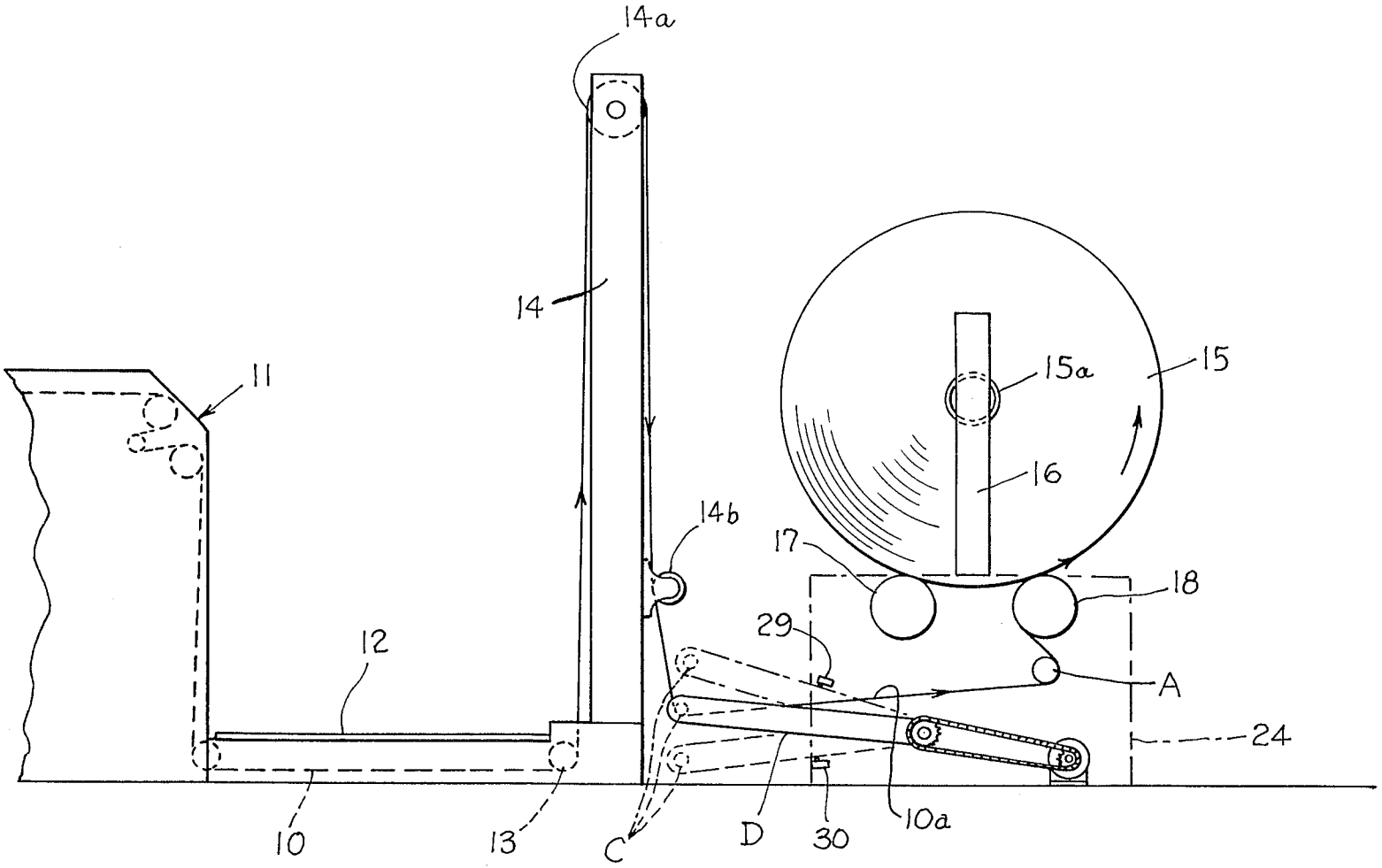
FIG. 1 is a side elevation illustrating cloth being fed forwardly from a loom and upwardly on an inspection device prior to being fed horizontally to the take-up mechanism with a tension control apparatus constructed in accordance with the present invention, carried thereon.
Figure 2:
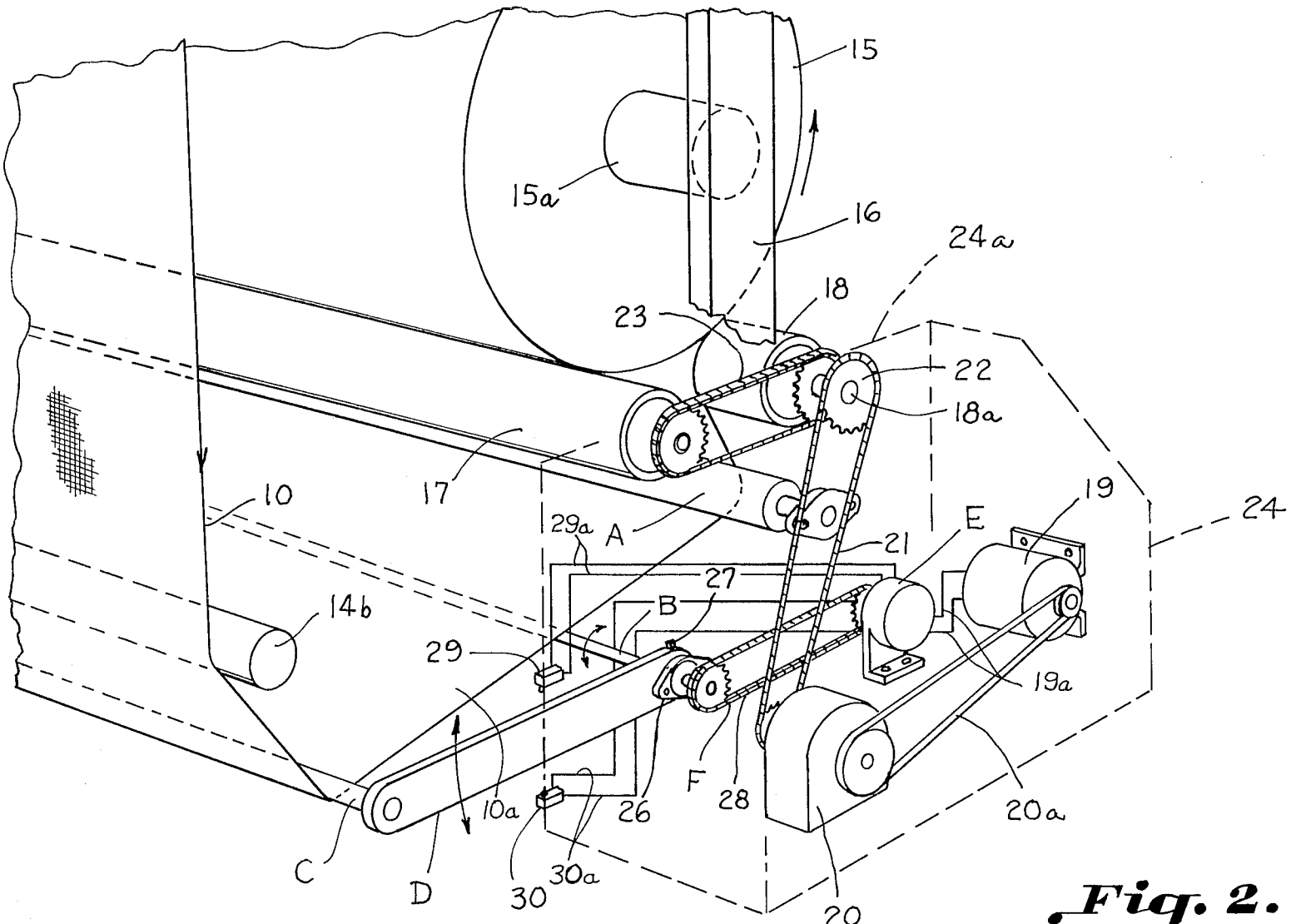
FIG. 2 is an enlarged, perspective view illustrating the tension control mechanism illustrated in FIG. 1 in greater detail.

Woven fabric or cloth 10 is illustrated in FIG. 1 as proceeding in open width from a loom, broadly designated at 11. Although the invention has particular application to looms, in addition to woven fabric, the invention contemplates usefulness with other fabric from other similar machines such as warp knit machines. The cloth proceeds under a walkway 12 in front of the loom, around a guide roll 13 and over a vertical rack 14 which has a roll **14*a* at the top and a lower guide roll 14*b* which may be provided for guiding the cloth on a horizontal run 10*a* to another guide roll A for being wound into a large cloth roll 15 upon a tube 15*a*. The rack 14 may serve as a cloth inspecting device. If desired, more elaborate inspection apparatus may be utilized. The roll 14*a* may be omitted on lighter weight fabrics. Spaced standards 16** are provided upon the take-up for guiding the buildup of the cloth roll.

The take-up is of the type employing a pair of spaced take-up rolls 17 and 18 driven by a motor 19, in this instance an electric motor, through a belt drive **20*a* to a gear reducer 10. A drive therefor includes a chain 21 which drives a sprocket 22 carried by the shaft 18*a* of the take-up roll 18. The roll 18 drives the roll 17 through a suitable drive which includes the chain 23. It should be noted that a housing 24 (shown in broken lines) for carrying various drive mechanism hereof, has a vertical wall or frame member 24*a*. The frame member 24*a* carries a bearing 25** for mounting the guide roll A for rotation on one end. Suitable bearing means, not shown, are provided for mounting various other rolls for rotation.

The control shaft B is carried for rotation in the bearing 26 carried upon the frame **24*a*. The movable roll C is supported upon the cloth 10 forming in this instance, a guide for one end of the horizontal, lateral run 10*a*. The arms D carry the movable sensing roll C for rotation adjacent one end thereof while the other ends have fixed connection, as by set screws 27, upon the central shaft B. Motor control means E include a variable transformer or other suitable means such as a rheostat (not shown) for connection through a suitable drive means F which in this instance is illustrated as including a chain 28 for controlling operation of the motor 19. Thus, the voltage supplied by lines 19*a* to the motor is varied controlling the speed through gear reducer 20 at which the rolls 17 and 18** are driven and hence controlling tension in the cloth.

Upper and lower switches 29 and 30, respectively, are carried on the inner side of the frame 24*a* for stopping the loom, by opening the circuit between the lines 29*a* or between the lines 30*a* if the tension in the cloth should become too high or too slack so as to cause engagement of one of the switches by the adjacent arm D. Thus, a further control is added keeping tension adjustments within an acceptable range. It is significant that the cloth is first carried on an upward path as on suitable inspection apparatus 14. By thereafter carrying the cloth on a sidewise path a sensor, such as the roll C, may engage the cloth to control the operation of the motor through suitable control means.

While a preferred embodiment of the invention has been described using specific terms, such description is for illustrative purposes only, and it is to be understood that changes and variations may be made without departing from the spirit or scope of the following claims.

What is claimed is:

1. Loom tension control apparatus for use in a cloth take-up having a motor driving a pair of spaced rolls carrying a cloth roll therebetween positioned in front of a machine from which cloth is delivered in open width to the cloth roll for winding thereon comprising:

means conveying said cloth in at least one substantially horizontal run during its delivery to the cloth roll;

means carrying said cloth on an upward path and a downward path prior to said horizontal run;

a control shaft carried for oscillation in axial alignment with said spaced rolls;

a movable roll supported by said cloth in said horizontal run, said roll being raised and lowered responsive to variations in tension in said cloth;

a pair of transversely spaced arms carrying the movable roll on one end thereof, the other end of said arms having connection with said control shaft for oscillating said control shaft responsive to variations in tension in the cloth in said horizontal run;

motor control means; and power transmission means connecting said motor control means for operation responsive to the oscillations of the control shaft.

2. The structure set forth in claim 1 including, limit switches carried on either side of said arms for discontinuing drive should cloth tension become too great or too slack.

* * * * *